US008161761B2

(12) United States Patent
Shao

(10) Patent No.: US 8,161,761 B2
(45) Date of Patent: Apr. 24, 2012

(54) METHOD AND APPARATUS FOR WINE CELLAR TEMPERATURE AND HUMIDITY CONTROL

(75) Inventor: Haoming Shao, Corona, CA (US)

(73) Assignee: Vinotemp International Corporation, Rancho Dominguez, CA (US)

( * ) Notice: Subject to any disclaimer, the term of this patent is extended or adjusted under 35 U.S.C. 154(b) by 1301 days.

(21) Appl. No.: 11/668,298

(22) Filed: Jan. 29, 2007

(65) Prior Publication Data

US 2008/0179413 A1 Jul. 31, 2008

(51) Int. Cl.
*F25B 49/00* (2006.01)
*F25D 21/14* (2006.01)
*F24F 3/14* (2006.01)

(52) U.S. Cl. ..... 62/176.6; 62/288; 236/44 C

(58) Field of Classification Search ..... 236/44 C; 62/176.6, 228.1, 285, 291
See application file for complete search history.

(56) References Cited

U.S. PATENT DOCUMENTS 5,694,785 A * 12/1997 Balentine ..... 62/275
6,070,424 A * 6/2000 Bauman et al. ..... 62/279
6,363,736 B1 * 4/2002 Kunkel et al. ..... 62/291

FOREIGN PATENT DOCUMENTS

JP 10332239 A * 12/1998

* cited by examiner

*Primary Examiner* — Chen Wen Jiang
(74) *Attorney, Agent, or Firm* — Kleinberg & Lerner, LLP; Marvin H. Kleinberg

(57) ABSTRACT

A self-contained climate control system for simultaneous temperature and humidity control in a wine cellar includes a refrigeration system having a conventional vapor-compression system including a condensate drip tray with over-flow passages. A programmable controller with a temperature sensor turns the compressor on and off by responding to the temperature sensor to regulate the air temperature in the wine cellar. The programmable controller keeps the system fans running after the compressor stops to cause evaporation of the water in the drip tray, restoring the moisture to the wine cellar.

16 Claims, 4 Drawing Sheets

METHOD AND APPARATUS FOR WINE CELLAR TEMPERATURE AND HUMIDITY CONTROL

FIELD OF THE INVENTION

This invention generally relates to climate control systems, and more particularly to the temperature and humidity control in a wine cellar.

BACKGROUND OF THE INVENTION

The storing condition for wine is critical to the proper wine aging. If wine is stored improperly, even if the wine bottle is sealed, it will age too rapidly and its essence will deteriorate. It is essential that the storing temperature not only be maintained at a desired value but also with a narrow fluctuation. The most suitable storing temperature for wine aging is around 55° F. at which wine develops most harmoniously. However, if there is a wide temperature fluctuation, the wine will experience disturbed chemical reactions that may significantly influence the taste of wine.

In order to prevent wine evaporation, a typical method to seal the bottle is the use of a cork, which still allows vapor and even liquid to pass through the cork. If the vapor pressure inside the wine bottle is greater than the outside, the inside vapor will escape through the cork and exacerbate the evaporation of wine from the bottle. Reversely, the outside vapor will tend to enter the bottle through the cork. Both these undesirable processes will change the critical organic compound balance of wine, and deteriorate the essence of wine.

Furthermore, the vapor pressure relates to the relative humidity of the air. The higher the relative humidity, the higher the vapor pressure. For instance, if the relative humidity in the wine cellar is maintained below 25%, the vapor generated inside the wine bottle will permeate through the cork and into the wine cellar. Of course, an extremely low relative humidity in the wine cellar will dry out the cork leading to a sealing problem. In contrast, a relative humidity of about 100% will ultimately lead to mold growing.

Storing wine in a climate controlled wine cellar is a suitable and economical way of aging wine wherein the climate controlled wine cellar includes means to maintain the air temperature and relative humidity at desired values. According to the natural storing climate, most wine cellars are maintained between 50° to 60° F. air temperature and 50 to 70% relative humidity, respectively.

To maintain the proper air temperature and relative humidity in a wine cellar, a refrigeration system is required to cool the air in the wine cellar. A humidification system is desired to humidify the air in order to maintain the proper relative humidity. Conventional climate control systems, such as air-conditioners and refrigerators, are not suited to achieve and maintain the desired air temperature and relative humidity simultaneously in a wine cellar.

For instance, a standard air conditioner can maintain air temperatures between 65° 80° F. with a resulting relative humidity of about 30 to 40%, which is good for humans. A refrigerator can maintain temperatures below 45° F. with a resulting relative humidity of about 20 to 30%. Accordingly, humidification must be provided by a separate system to maintain a proper relative humidity. Consequently, a climate control system for maintaining the ideal air temperature and relative humidity in a wine cellar would require the installation of two separate systems and necessary maintenance such as a water source.

Therefore, a self-contained climate control system for use in a wine cellar, which will be able to control the air temperature in a relatively desired range such as between 50 to 60° F. as well as the relative humidity in the range 50 to 70%, would be desirable and is not currently available. It is an object of the invention to provide a continuous and economical method and apparatus for maintaining the temperature and relative humidity within the narrow ranges that are desirable for the storage of wine.

BRIEF SUMMARY OF THE INVENTION

A self-contained climate control system for simultaneous temperature and humidity control in a wine cellar includes a refrigeration system and a programmable controller with a temperature sensor. The refrigeration system includes a conventional vapor-compression system having a compressor, a hot-gas tube, a condenser, a flow control device, an evaporator, a condensate drip tray, condenser fans and evaporator fans. The evaporator provides cold air which is circulated in the wine cellar. The condenser extracts heat from the wine cellar and the compressor and vents it to the exterior.

The condensate drip tray has over-flow passages to prevent flooding and for storing the water condensed by the evaporator. The programmable controller provides one relay output for the compressor and another relay output for both the condenser and evaporator fans. The refrigeration system responds to the temperature sensor to turn the compressor on and off. By this action, the refrigeration system regulates the air temperature in the wine cellar.

In addition, the programmable controller keeps the fans running for a preset period after the compressor stops, which restores moisture to the wine cellar by evaporating the liquid from the evaporator and drip tray. The air humidity will be modulated using an open loop control by the change of fan running time. As a result, there is provided a self-contained temperature and humidity control system that does not need a separate humidification or dehumidification unit.

DETAILED DESCRIPTION OF THE INVENTION

Figure 1:
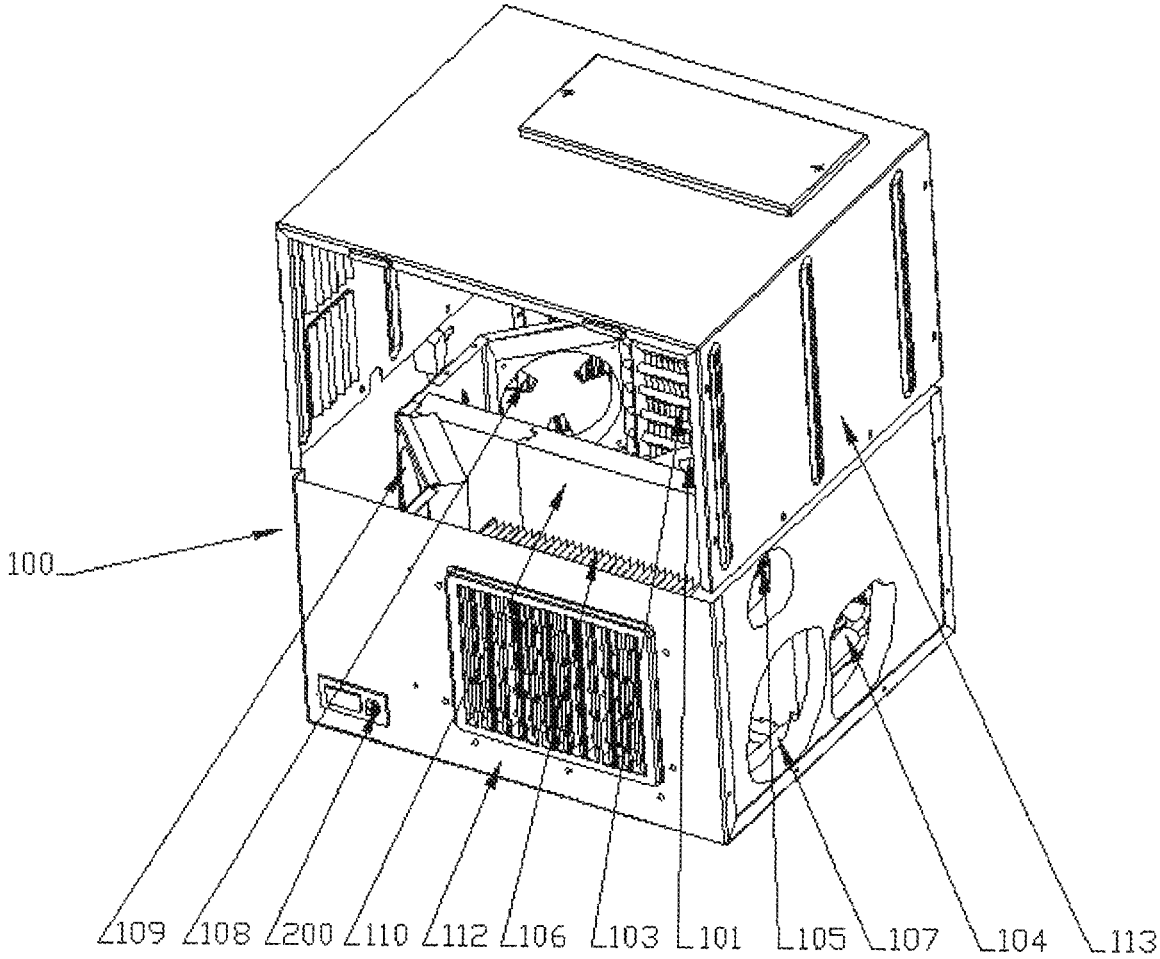
FIG. 1 is a perspective view of the preferred embodiment of the present invention with the upper housing moved up.

The preferred embodiment of the present invention is shown in FIG. 1. A refrigeration system 100 is equipped with a programmable controller 200 that has a temperature sensor 203, discussed below in FIG. 3. The refrigeration system 100 includes a conventional vapor-compression system having a compressor 101, a hot gas tube 102 (shown in greater detail in FIG. 2), a condenser 103, a flow control device 105, an evaporator 106, a condensate drip tray 107, condenser fans 108 and evaporator fans 109. Insulation foam 110 is provided to reduce noise and, as noted below, to separate the "cold" side from the "hot" side. The condenser fans 108 exhaust hot air to the exterior of the wine cellar and the evaporator fans 109 send the cooled air into the wine cellar and may be considered cooling fans. The system also includes a lower housing 112 and an upper housing 113.

Figure 2:
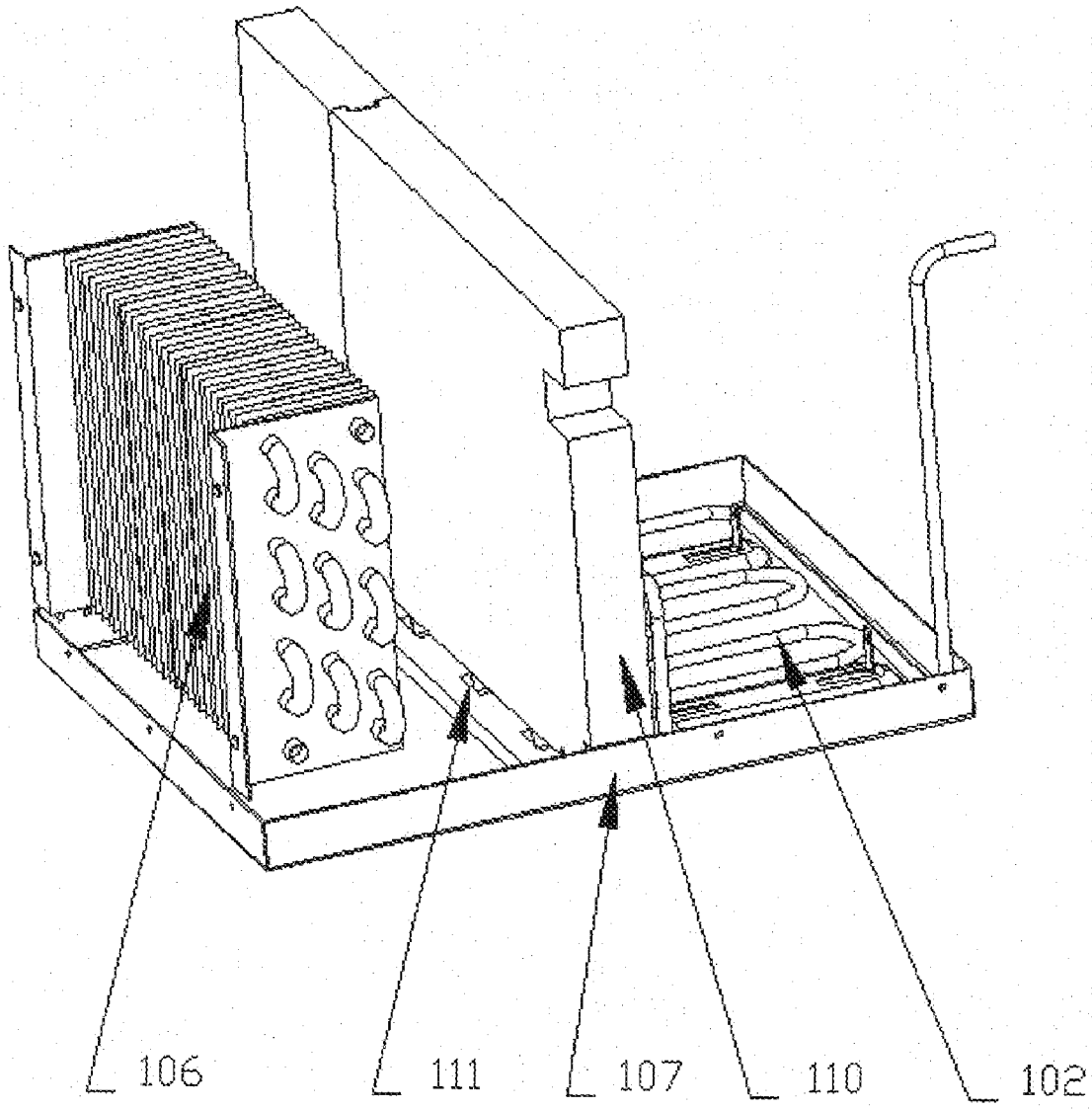
FIG. 2 is a perspective view of the condensate drip tray, over-flow passages, evaporator and hot-gas tube of the preferred embodiment of FIG. 1.

As shown in FIG. 2, the condensate drip tray 107 has over-flow passages 111 for the purpose of preventing flooding and for storing some of the water condensed by and dripped from the evaporator 106. The insulation foam 110 separates the "cold" side and "hot" of the system 100.

Figure 3:
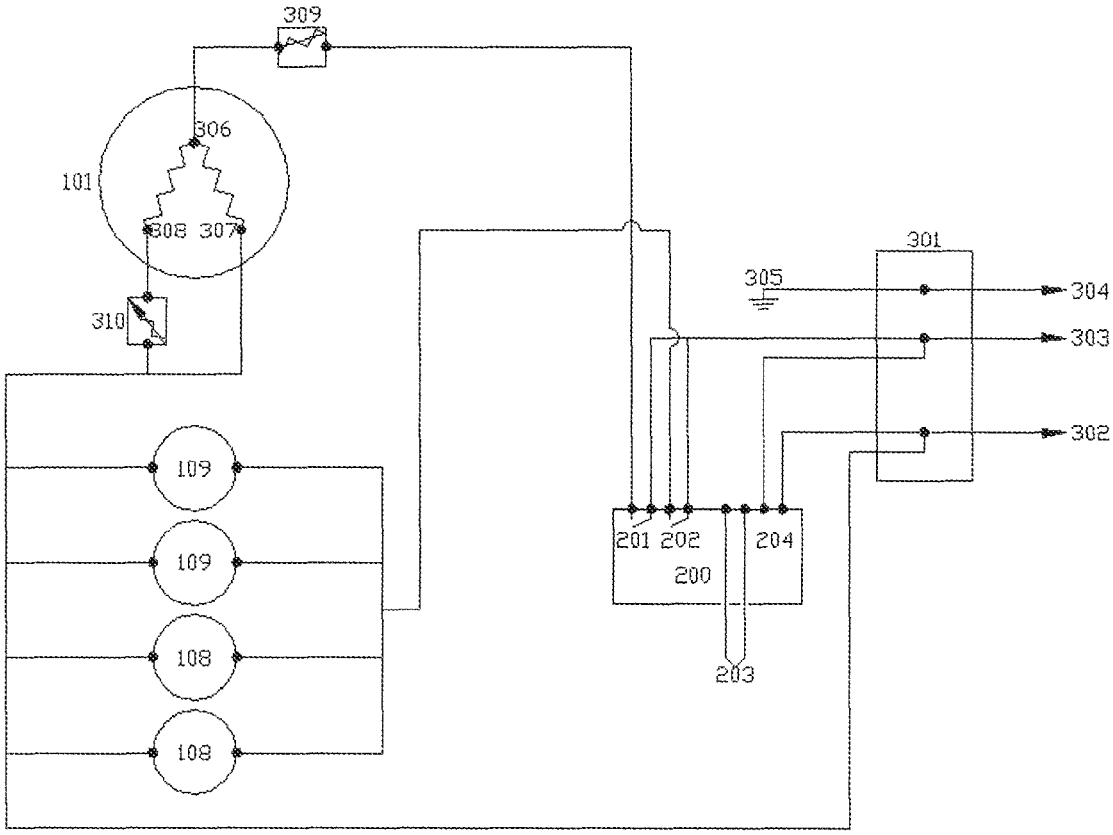
FIG. 3 is an electrical wiring diagram of the preferred embodiment of FIG. 1.

The programmable controller 200 in FIG. 1, in the preferred embodiment, provides one relay output 201 for the compressor 101 and the other relay output 202 for both the condenser fans 108 and evaporator fans 109 as shown in FIG. 3. As can be seen from the electrical wiring diagram, the compressor 101, the condenser fans 108 and the evaporator fans 109 are wired separately to different relays 201, 202.

The programmable controller 200 turns the compressor 101 on and off by responding to a temperature sensor 203. As a result, the refrigeration system 100 regulates the air temperature in the wine cellar. Furthermore, the programmable controller 200 keeps the fans 108, 109 running after the compressor 101 stops for a settable time period, which restores the moisture to the wine cellar from the cold evaporator 106 and drip tray 107. The air humidity will be modulated using an open loop control by changing the duration of the fan running time.

In the preferred embodiment, the refrigeration system 100 employs a flow control device 105, (see FIG. 1) which can be a capillary tube, a thermostatic expansion valve, an electrically driven valve or another device. Alternatively, a heat exchanger, placed between a suction tube and a capillary tube can be used to enhance the performance.

In the preferred embodiment of the present invention (and referring back to FIG. 1), the condenser 103 and evaporator 106 are both finned-tube heat exchangers. The fins can be made of aluminum, copper or steel. Furthermore, the distance between fins needs to be designed for optimum heat transfer and water condensation dripping. The condensate drip tray 107 has over-flow passages 111.

As opposed to conventional, standard refrigeration systems, in which the water dripped from the cold heat exchanger needs to be removed, in the preferred embodiment of the present invention, the condensate drip tray 107 is designed such a way that the water dripped from the evaporator 106 will stay in the evaporator 106 side and will not escape to the hot-gas tube 102 side immediately. As a result of this arrangement, only excessive water will be removed.

In the preferred embodiment, the main function of the cooling or evaporator fans 109 is to circulate the air in the wine cellar over the evaporator 106 to transfer heat. When the compressor 101 runs, the temperature of the evaporator 106 will fall below the dew point of the air in the wine cellar, and the moisture in the air will condense. Consequently, the relative humidity of the air in the wine cellar will be reduced. Furthermore, when the compressor stops, the temperature of the evaporator 106 will rise over the dew point, and the water will drip into the drip tray 107. If, after the compressor 101 stops, the fan 109 running time is set to 0, the preferred embodiment of the invention will function as a dehumidification unit.

In contrast, if, after the compressor 101 stops, the evaporator fan 109 running time is set to some arbitrary value, the preferred embodiment will function as a humidification unit by causing the condensate to evaporate. Depending on the surrounding conditions, setting the post compressor 101 evaporator fan 109 running time will adjust the humidity levels in the wine cellar. In the preferred embodiment, it has been found that if a temperature of 45° is to be maintained, a running time of 30 minutes is appropriate. Similarly, running times of 20 and 10 minutes are utilized to maintain humidity levels at temperatures of 55° and 60°, respectively. Preferably, the programmable controller 200 is a digital controller having separate relay outputs 201, 202 for the compressor 101 and for both condenser fans 108 and evaporator fans 109, respectively. However, a separate electromechanical controller or a humidistat can be used to accomplish a similar purpose.

Figure 4:
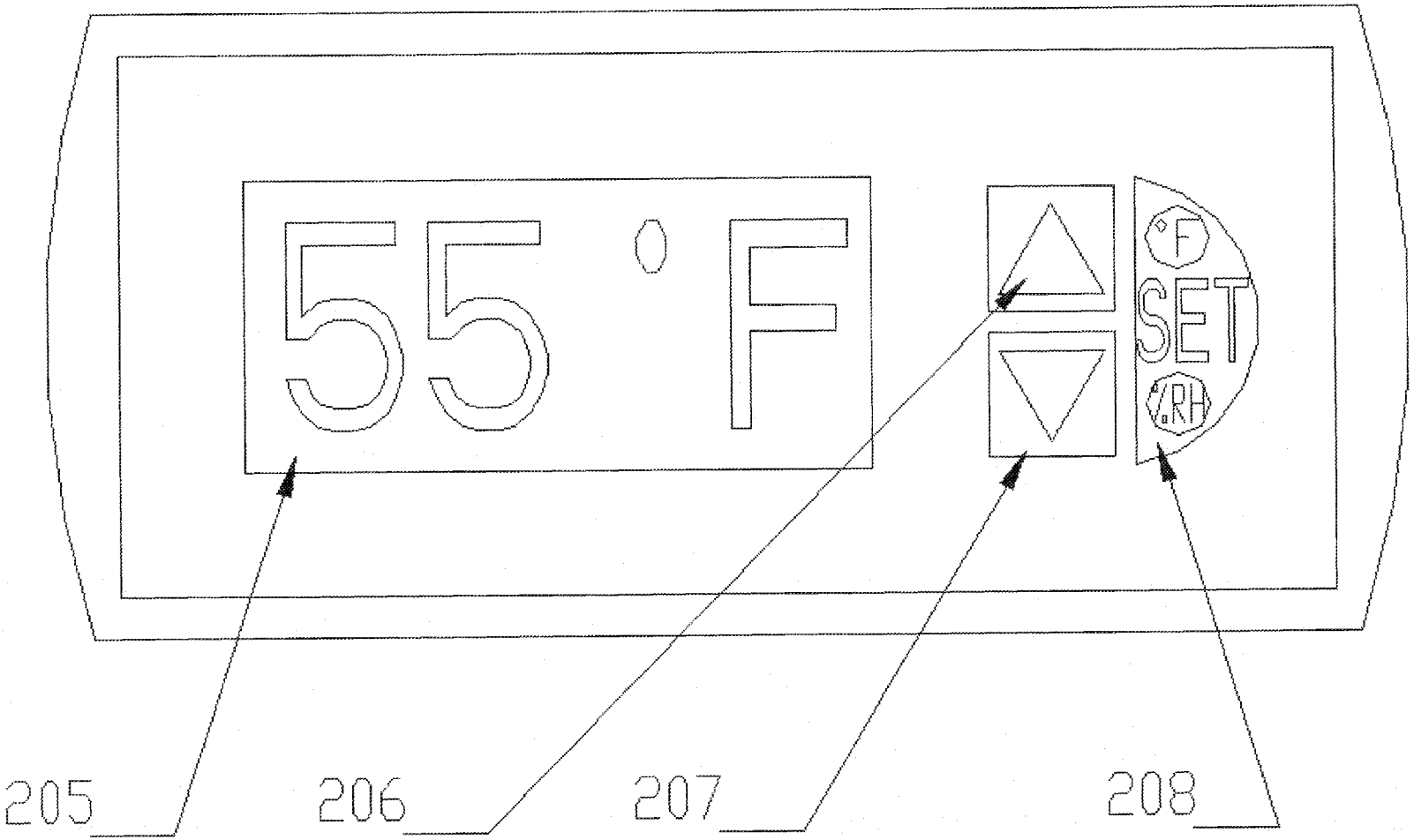
FIG. 4 is a view of the controller.

In FIG. 4, a suitable controller 200 is shown, calibrated for temperature so that a setting of a desired temperature will be translated into an appropriate running time for the condenser fans 108 and evaporator fans 109 when used for setting humidity levels. In a preferred embodiment, the controller 200 includes a display 205 which may be an LCD. A pair of control buttons 206, 207, are used to increase and decrease, respectively, the value shown in the display 205 for the purposes of setting the temperature or the humidity level. That choice is controlled by a rocker switch 208 which alternatively controls the temperature or humidity. As shown, the upper part of the switch 208 has a symbol "° F." representing temperature and the lower part has the symbol "% RH" representing relative humidity.

Therefore, the advantage of the present invention is to provide a method and apparatus to simultaneously control temperature and humidity using a self-contained system that does not need a humidification unit, a dehumidification or a secondary water source. The preferred embodiment of this invention is particularly suited to a "reach-in" wine cellar in which the air temperature and relative humidity need to be maintained at a desired value and with a narrow fluctuation. However, it is to be understood that various modifications may be used without departing from the principle of the present invention scope.

Accordingly, the breadth and scope of the invention should be limited only by the scope of the claims appended hereto.

What is claimed as new is:

1. A self-contained climate control system for simultaneous temperature and humidity control of a wine cellar comprising:

a refrigeration system including a compressor, a condenser, and an evaporator;

an insulating barrier dividing said system into a cold side and a hot side;

a condenser fan on said hot side for dissipating heated air out of the wine cellar;

an evaporator fan on said cold side for circulating cooled air into the wine cellar a condensate drip tray having a portion on said cold side and a portion on said hot side adapted to receive moisture condensed from said refrigeration system;

a programmable controller connected to said refrigeration system for setting a temperature for the wine cellar which selects an operating time for said evaporator fan to run after said compressor is stopped to evaporate condensed moisture from said cold side into the wine cellar to maintain the humidity therein; and a temperature sensor connected to said programmable controller for signaling the air temperature in the wine cellar to said controller;

whereby said controller runs said compressor until said sensor signals that a preset temperature has been reached within the wine cellar.

2. A climate control system in accordance with claim 1, wherein said evaporator employs finned-tubes.

3. A climate control system in accordance with claim 1, wherein said condenser employs finned tubes.

4. A climate control system in accordance with claim 1, wherein said condensate drip tray has over-flow passages to prevent flooding and for storing excess water dripped from said refrigeration system on said hot side.

5. A climate control system in accordance with claim 1, wherein said programmable controller has separate relay outputs for said compressor and said fans, and is programmable to set running times for said fans after said compressor stops related to the set temperature and wherein each temperature setting selects an appropriate running time for said evaporator fan.

6. A climate control system in accordance with claim 5, wherein said compressor and fans are wired to said separate relay outputs of said programmable controller.

7. A climate control system in accordance with claim 1, said refrigeration system further includes an evaporator on said cold side wherein said cooling fan is an evaporator fan.

8. A self-contained climate control system for simultaneous temperature and humidity control of a wine cellar comprising:

a refrigeration system including a compressor and a cooling fan for circulating air into the wine cellar;

an insulating barrier separating said system into a "cold" side and a "hot" side;

a condensate drip tray with a portion on said cold side and a portion on said hot side, adapted to receive moisture condensed from said refrigeration system;

a programmable controller connected to said refrigeration system and to said cooling fan for alternatively selecting a temperature and a relative humidity wherein each temperature setting selects a corresponding running time interval for said cooling fan; and a temperature sensor connected to said programmable controller for signaling air temperature in the wine cellar;

whereby said controller is operable to regulate temperature by running said compressor until said temperature sensor senses a preset temperature value and to regulate humidity by operating said cooling fan for a predetermined time after said compressor is stopped, selected by the temperature setting, thereby evaporating condensed moisture from said cold side into the wine cellar.

9. A climate control system in accordance with claim 8, wherein said evaporator employs finned-tubes.

10. A climate control system in accordance with claim 8, said refrigeration system further including a condenser for dissipating heat and a condenser fan for discharging heated air from the wine cellar to the exterior.

11. A climate control system in accordance with claim 10, wherein said condenser employs finned tubes.

12. A climate control system in accordance with claim 8, wherein said condensate drip tray has over-flow passages to prevent flooding and for storing on said hot side excess water dripped from said refrigeration system.

13. A climate control system in accordance with claim 8, wherein the condensate drip tray hot side portion has a hot-gas tube to vaporize excessive water into the external environment.

14. A climate control system in accordance with claim 8, wherein said programmable controller has a separate relay output for said compressor and said cooling fan, programmable to set different fan running times after said compressor is stopped.

15. A climate control system in accordance with claim 14 wherein said compressor and said fan are wired to said separate relay outputs of said programmable controller.

16. A climate control system in accordance with claim 8 wherein said programmable controller can be set alternatively for temperature or relative humidity and where each temperature setting determines the running time after condenser turn off for said evaporator fans.

* * * * *